US011918923B2

(12) United States Patent
Yarro

(10) Patent No.: US 11,918,923 B2
(45) Date of Patent: Mar. 5, 2024

(54) DICE COIN

(71) Applicant: Yarro Studios, Inc., Orem, UT (US)

(72) Inventor: Tanner Yarro, Provo, UT (US)

(73) Assignee: Yarro Studios, Inc., Orem, UT (US)

( * ) Notice: Subject to any disclaimer, the term of this patent is extended or adjusted under 35 U.S.C. 154(b) by 0 days.

(21) Appl. No.: 18/107,234

(22) Filed: Feb. 8, 2023

(65) Prior Publication Data

US 2023/0249056 A1 Aug. 10, 2023

Related U.S. Application Data

(60) Provisional application No. 63/307,925, filed on Feb. 8, 2022.

(51) Int. Cl.
*A63F 7/04* (2006.01)

(52) U.S. Cl.
CPC ..... *A63F 7/048* (2013.01)

(58) Field of Classification Search
CPC .... A63F 7/048; A63F 7/04; A63F 5/04; A63F 3/00697; A63F 2003/00703; A63F 11/0011; A63F 5/02; A44C 21/00
USPC ..... 273/144 R
See application file for complete search history.

(56) References Cited

U.S. PATENT DOCUMENTS 479,432 A * 7/1892 Lathrop ..... A63F 7/044 273/115
600,696 A * 3/1898 Patterson ..... A63F 7/044 273/153 R
658,097 A * 9/1900 Smith ..... A63F 7/044 273/115
2,262,891 A * 11/1941 Gortner ..... A63F 7/048 273/146
2,601,985 A * 7/1952 Yerkes ..... A63F 5/0088 273/123 R
3,674,275 A * 7/1972 Samson ..... A63F 5/02 273/120 R
4,244,584 A 1/1981 Viveiros
4,336,938 A * 6/1982 Laroche ..... A63F 5/02 273/123 R
4,796,890 A * 1/1989 Snyder ..... A63F 7/048 273/144 B (Continued)

FOREIGN PATENT DOCUMENTS

WO 2016055820 A2 4/2016

OTHER PUBLICATIONS

Video entitled FlipDie: The World's First Dice You Flip Like a Coin., available at <http://www.youtube.com/watch?v=zd5LmKC6-OM> (FUNDINGINSIDER) Oct. 18, 2022 (Oct. 18, 2022), entire document.

(Continued)

*Primary Examiner* — Michael D Dennis
(74) *Attorney, Agent, or Firm* — DENTONS Durham Jones Pinegar

(57) ABSTRACT

A coin for use in games of chance includes a first side connectable to a second side and forming a coin interior when the first side is connected to the second side. A ball held in place in the coin interior, which interior includes a plurality of ridges and valleys with sloped surfaces for biasing a ball toward a periphery, which may include pockets, of the coin when the coin is flipped or rolled. Each pocket may be next to a viewing window, allowing the ball within the pocket to be viewed from the exterior of the coin.

7 Claims, 9 Drawing Sheets

(56) References Cited

U.S. PATENT DOCUMENTS

| | | | | |
|---|---|---|---|---|
| 4,984,796 | A * | 1/1991 | Peacock | A63F 5/0088 273/142 E |
| 5,018,738 | A | 5/1991 | Padi | |
| 6,032,615 | A | 3/2000 | Girard | |
| 2015/0246262 | A1 | 9/2015 | Chiu | |
| 2016/0166922 | A1 | 6/2016 | Estrada et al. | |

OTHER PUBLICATIONS

USPTO acting as International Searching Authority, "International Search Report and Written Opinion," International Application No. PCT/US2023/012622, dated May 30, 2023.

* cited by examiner

DICE COIN

CROSS REFERENCE TO RELATED APPLICATION

A claim for priority to the Feb. 8, 2022 filing date of U.S. Provisional Patent Application No. 63/307,925, titled DICE COIN ("the '925 Provisional Application"), is hereby made pursuant to 35 U.S.C. § 119(e). The entire disclosure of the '925 Provisional Application is incorporated herein by reference.

TECHNICAL FIELD

This disclosure relates generally to devices to be used in a game of chance or other games involving a die or dice. More specifically, to a coin to be used in a game that involves chance or other game or games such as Dungeons and Dragons ("D&D"). The features disclosed herein may be numerous in nature and may be employed in various different ways to provide the same or similar results. The following description may refer to the design as a coin, a dice coin, or a die coin, all of which refer to the same element.

RELATED ART

Dice have been used for centuries, both for games of leisure and for determining other outcomes based on chance. People take an enormous interest in games that involve at least some aspect of chance, and such games are widely popular around the world. These games often use a 6-sided common die, or a pair of dice, etc. Additionally, alternate dice have been used that incorporate a greater number of sides than the 6-sided die for games such as roleplay games or D&D type games.

For purposes of this disclosure, "die" or "dice" means any apparatus with a discrete number of different positions or spots, which may be thrown, tossed, etc., and used in gambling and other games involving chance. Many types of games use dice to determine at least one aspect involving chance, such as games that involve players moving a particular number of positions on a board, players getting a particular opportunity, etc. Another way to determine an aspect of games involving chance is a coin flip. However, a coin flip of a standard coin allows only two options, while a 6-sided die allows 6 options. In some games, even more options may be desired and multi-sided dice (such as a die formed of an icosahedron) may be used.

SUMMARY

This disclosure relates to various methods and embodiments of a coin to be used in games including roleplaying games and other games that involve chance. More specifically, this disclosure relates to a coin.

According to one aspect, the coin includes a first side connectable to a second side and forming a coin interior when the first side is connected to the second side.

At least one ball may be held in place in the coin interior. Each interior face of the coin comprises at least a first sloped surface and a second sloped surface, the first sloped surface sloped downwardly from a center of the coin to an edge of the coin and sloped towards a first viewing window, the first sloped surface forming a first receptacle for receiving the ball at a base of the first sloped surface and a first viewing window, and the second sloped surface sloped downwardly from the center of the coin to the edge of the coin toward a second viewing window, the second sloped surface forming a second receptacle for receiving the ball at a base of the second sloped surface and a second viewing window.

One or more viewing windows are provided at an edge of the coin, or at an exterior of the coin. In some configurations, the edge of the coin comprises the first viewing window and the second viewing window, each of the first viewing window and the second viewing window allowing the ball to be visible within one of the first receptacle and the second receptacle of the coin without allowing the ball to exit the coin interior of the coin.

According to another aspect, a coin for use in games of chance comprises: a coin interior with at least one ball held in place in the coin interior, the coin interior having a plurality of sloped surfaces sloping downwardly from a center of the coin interior to an edge of the coin interior.

In some configurations, the plurality of sloped surfaces comprise a plurality of ridges and valleys.

According to one aspect, of the plurality of sloped surfaces has a base, each base of each sloped surface forming a pocket for receiving the ball.

A viewing window may be formed in an edge of the coin at each pocket, the viewing window allowing the at least one ball to be viewed from an exterior of the coin when the ball is in at least one of the pockets.

In some configurations the plurality of sloped surfaces sloping downwardly from a center of the coin interior to an edge of the coin interior comprise a plurality of ridges and valleys.

According to another aspect, the coin is formed at least partially of one of translucent and transparent material.

In some configurations, the coin is formed of a first side removably connected to the second side, the first side and second side forming the coin interior when they are connected. In other configurations, the coin is formed of a single piece and not two connected sides.

In some embodiments, a coin may comprise a body with an exterior and an interior with the exterior comprising a top surface, a bottom surface and a perimeter surface extending between the top surface and bottom surface. The perimeter surface may include at least one window to the interior of the coin. The interior may comprise a void the void comprising a plurality of sloped surfaces sloping from a center of the coin to a periphery of the coin, toward the at least one window. A ball may reside within the void and may be freely movable within the interior.

The coin may be larger than the window such that the ball is observable from the window but not removable from the window.

The sloped surfaces may each connect at a point, or pocket, wherein the ball resides within the window.

In some configurations the coin may comprise an exterior top surface and an exterior bottom surface and a window formed in the edge of the coin, wherein at least one marking is positioned at the window on both the top surface and bottom surface, the at least one marking symbolizing a value that relates to the game of chance. The coin with the at least one marking on the top surface may be the same as the at least one marking on the bottom surface. Alternatively, the at least one marking on the top surface may be different from the at least one marking on the bottom surface.

In other configurations a coin may be used in a game by connecting a first side of a coin to a second side of the coin, forming a coin interior. Positioning a ball held in place in the coin interior wherein each of the first side and the second side of the coin include an exterior circumference with at least one cut-out in the exterior circumference, each of the at least one cut-out forming a window for receiving the ball. The ball may be viewed in the window within the coin interior.

The coin may be include forming a plurality of sloped surfaces on an interior surface of the coin interior; wherein each of the plurality of sloped surfaces is sloped toward the window for receiving the ball. The plurality of sloped surfaces may bias the ball toward the window for receiving the ball.

DETAILED DESCRIPTION

Figure 1:
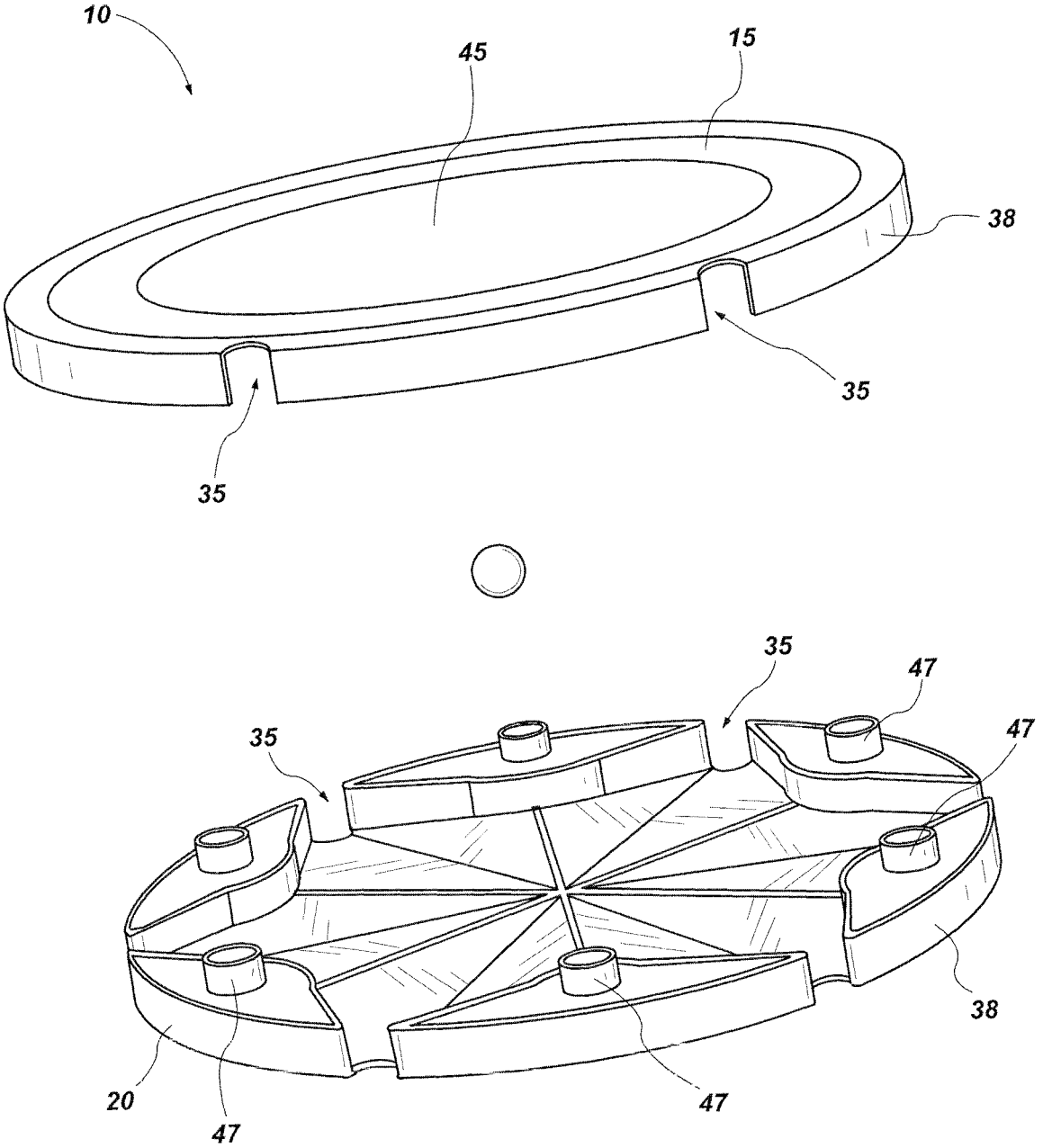
FIG. 1 is a top exploded perspective view of a coin.

FIGS. 1-5 illustrate an embodiment of a coin 10. The coin generally includes a first side or first portion 15, or top portion, connectable to a second side or second portion 20, or bottom portion. When the first side 15 is connected to the second side 20, a coin interior 24, or void, is formed, and a ball 29, or ball bearing, may be trapped or held in place within the coin interior 24. One or more cut-outs or apertures 35 are provided on the perimeter 38, or edge of the coin, forming one or more windows 40, or viewing windows, for viewing the ball 29 within the coin interior. The interior of the coin is similar to a roulette wheel, with the ball 29 traveling along ridges 54 and valleys 58 of the interior of the coin until the ball loses momentum and falls down one of the valleys 58 and lands in a window 40, or viewing window, which may be within a pocket 55, as described in more detail herein (refer to FIG. 4). The pocket 55 may simply be the terminal point where each of the sloped surfaces connect at the cut-outs 35 or window 40.

Figure 2:
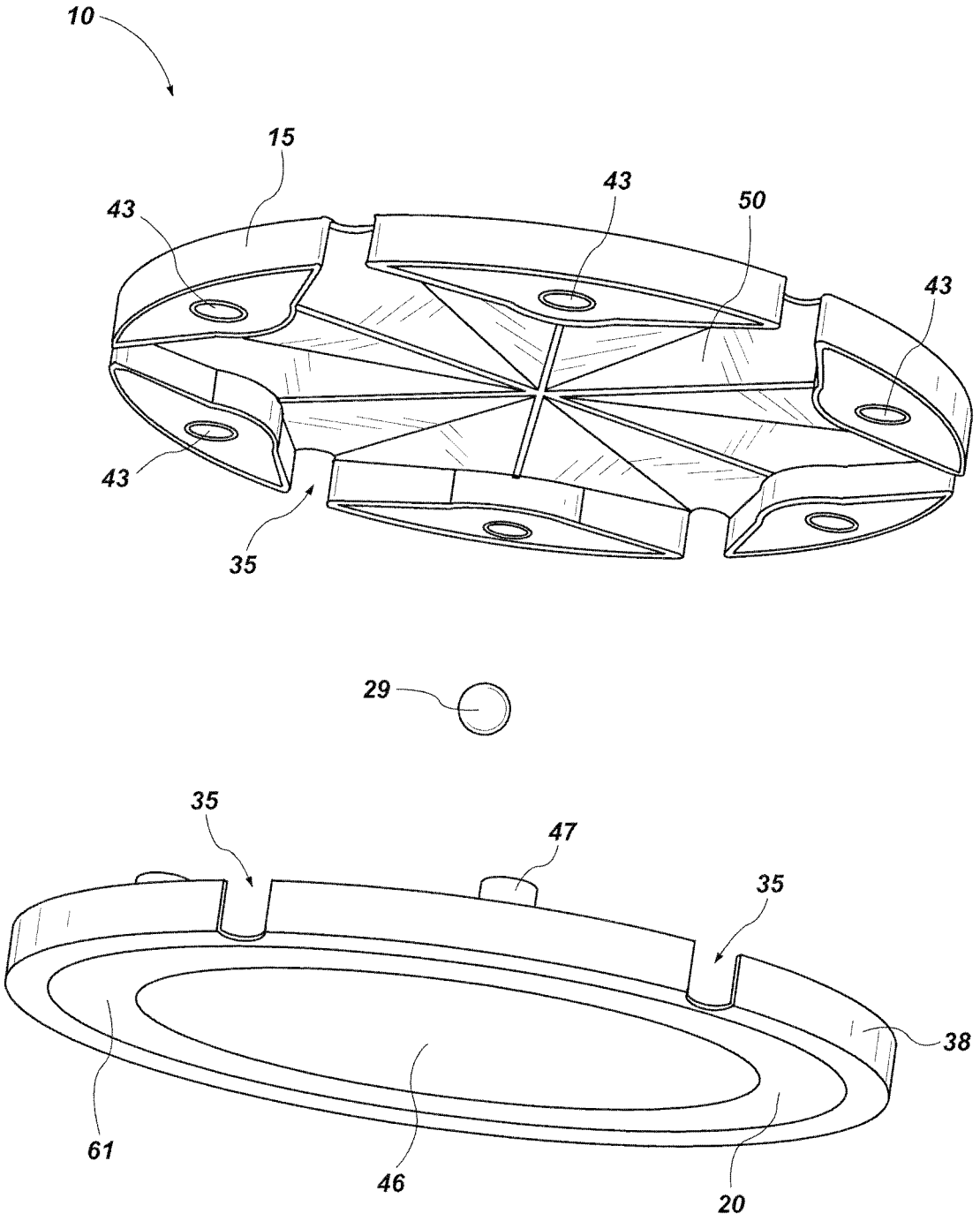
FIG. 2 is a bottom exploded perspective view of the coin of FIG. 1.

The first side 15 of the coin may be connected to the second side 20 of the coin in many different ways. The connection can be reversible, so the two sides can be separated and the coin can be opened to allow users to access the interior 24 of the coin. In other configurations the first side 15 and second side 20 of the coin are permanently connected and the coin interior 24 cannot be accessed. FIGS. 1-2 show a reversible connection with circular recesses 43 provided in the first side 15, and corresponding mating circular projections 47 provided in the second side 20. The projections 47 and recesses 43 may take any polygonal or circular shape. Additionally, the projections 47 and recesses 43 may be connected with a frictional fit, press-fit, snap fit, glued, welded, or any other means known in the art. Other reversible or non-reversible connections can be used to mate the first side 15 of the coin 10 to the second side 20. Or, the coin 10 may be formed of a single piece, or unitary piece, and the ball 29 may be pressed into the interior, for example, through one of the viewing windows 40. Alternative means to secure two sides 15, 20, of the coin 10 together are considered including clips, magnets, tape, and the like.

Figure 5:
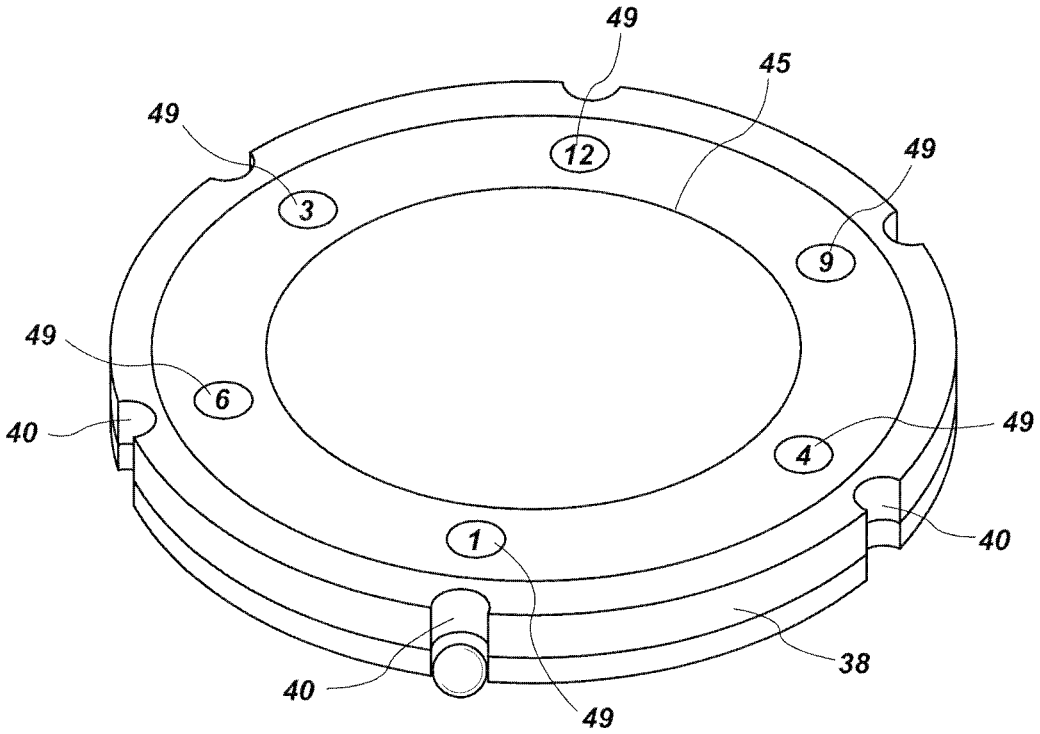
FIG. 5 is a perspective view of the coin of FIG. 4, with both sides of the coin joined together.

The perimeter 38 of the two portions of the coin include at least two cut-outs 35 forming viewing windows 40 (viewing windows 40 shown in FIG. 5 where both sides of the coin are pressed together). These cut-outs 35 in the first side of the coin and the second side of the coin align to form viewing windows 40 at the perimeter 38 of the coin. The viewing windows 40 allow the position of the ball to be seen within the interior of the coin, while still maintaining the ball 29 within the interior of the coin. The cut-outs 35 (and by nature the viewing windows 40) may be smaller than the diameter of the ball 29 such that the ball remains within the interior 24 of the coin 10 while allowing a user to view the location of the ball 29.

Two cut-outs 35 may be used on each portion of the coin to form two viewing windows, or three, four, five, six, or more cut-outs 35 may be used to form the desired number of viewing windows 40. As described in more detail below, the number of viewing windows 40 may correspond to the number cut-outs 35 as well as correspond to the number of sloped surfaces within the interior 24 of the coin 10.

Figure 3:
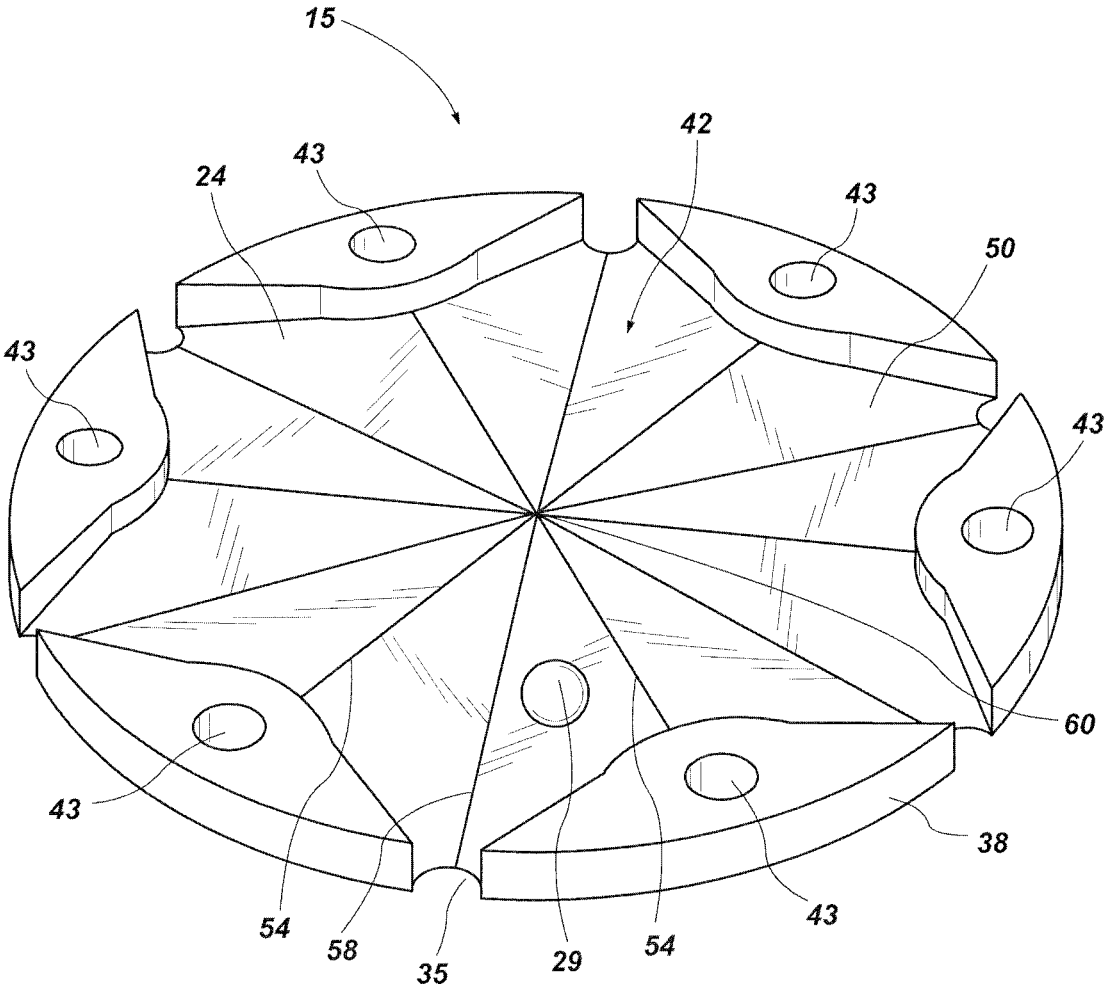
FIG. 3 is a perspective view of the interior of one side of the coin of FIG. 1.
Figure 6:
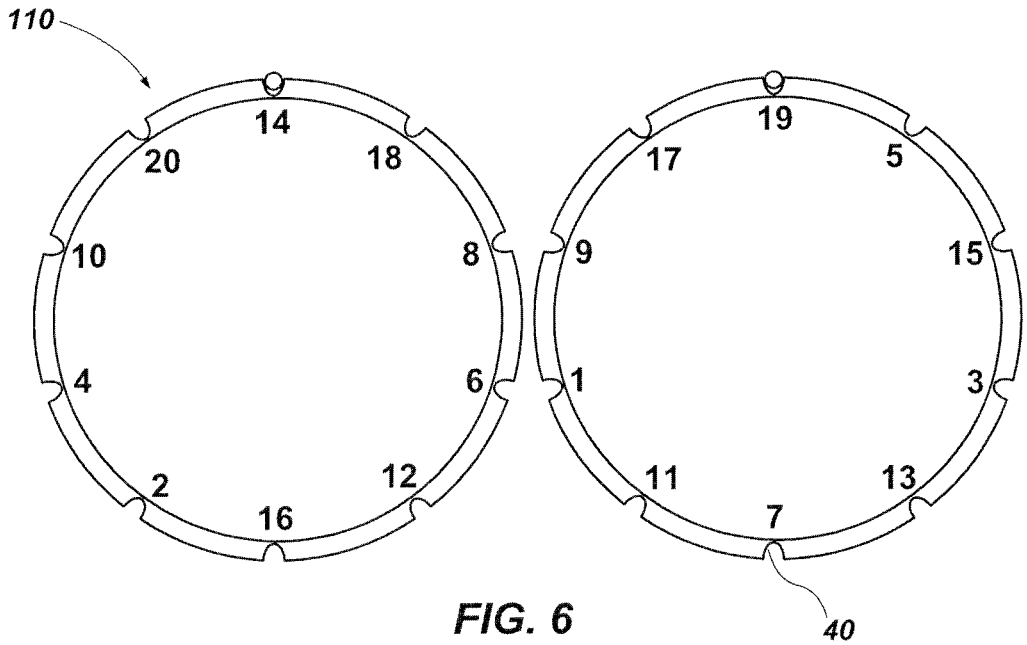
FIG. 6 is a top view of the exterior of two coins having a different configuration with additional pockets and viewing windows (it will be appreciated that this may also be considered a top view and bottom view of the same coin)
Figure 7:
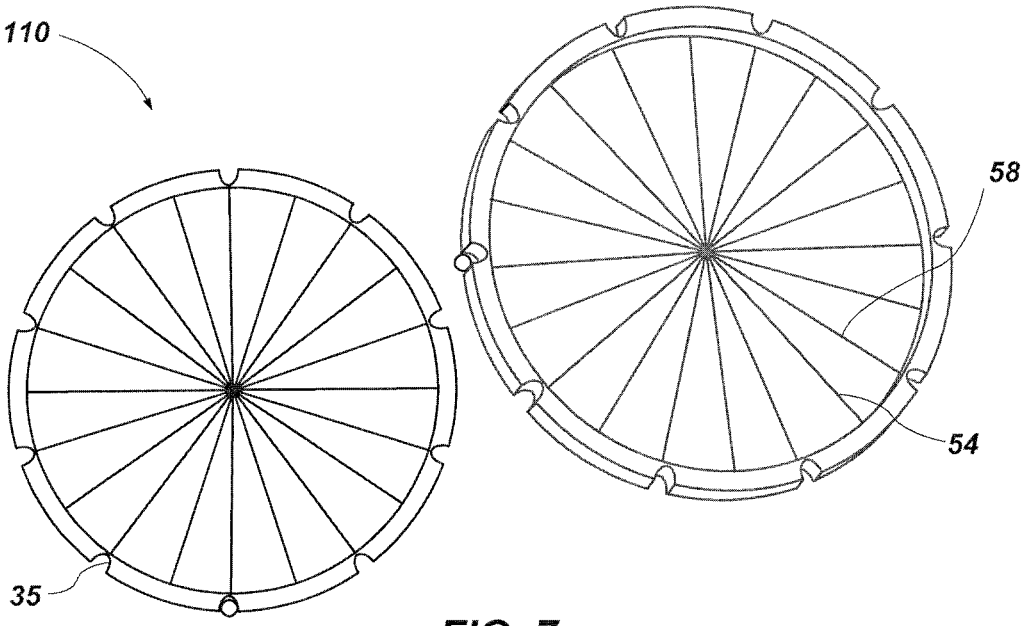
FIG. 7 is a top view of the interior of the two coins of FIG. 6 with a plurality of ridges and valleys (it will be appreciated that this may also be considered an interior top view and an interior bottom view of the same coin)
Figure 8A:
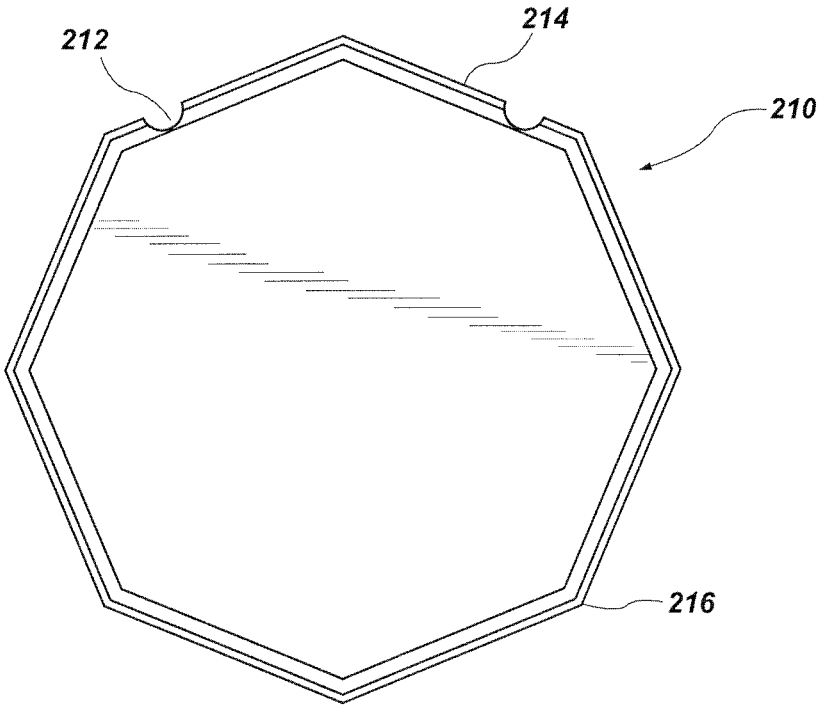
FIG. 8*a* is a top view of an alternate embodiment of a coin with a polygonal shape.
Figure 8B:
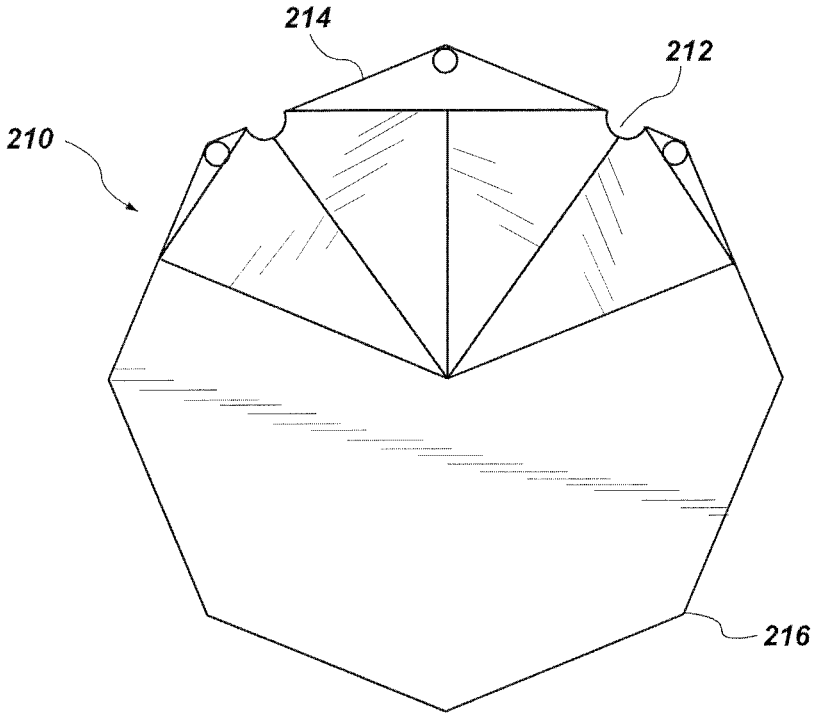
FIG. 8*b* is an top view of the coin of FIG. 8*a* with a portion of the coin face cut away showing a partial interior of the coin.

By way of example, FIGS. 1-3 show a coin 10 with 6 viewing windows, while FIGS. 6-7 show coins 110 with 10 viewing windows. The cut-outs 35 may be provided in both sides of the coin, or in other configurations, only one side of the coin may be provided with the cut-outs 35 to form a viewing window. In other configurations, cut-outs 35 are not provided. Instead, the coin 10 may be provided with transparent or translucent portion(s) that act as viewing windows 40. Or cut-outs may be provided and covered in a transparent or translucent material. In yet other configurations, the entire coin 10 may be formed of transparent or translucent materials to allow the ball 29 to be viewed in the interior 24 of the coin 10.

FIGS. 1-3 show cut-outs 35 with a semi-circular shape cut through a face 45 of the coin, from the interior surface 42 to the face 45, which may be an exterior top or bottom surface, and extending down the perimeter 38 of the coin. This forms a viewing window with a generally semi-circular shape on the interior surface 42 and the face 45 of the first side 15 of the coin, extending through the perimeter 38 of the coin, and a generally semi-circular shape on a second face 46 of the second side 20 of the coin 10. Other shapes may be provided for the cut-outs 35, and viewing window(s) 40 can be any desired shape. A viewing window may be cut into the perimeter 38 and face of the coin as shown in FIGS. 1-3, or the viewing window may be cut into only the perimeter 38 or only one of the face 45 or the second face 46, or both faces 45, 46 of the coin.

The location of the viewing windows 40 may correspond to the location of a pocket for receiving the ball in the interior 24 of the coin. The cut-outs 35 or viewing windows may be positioned proximal to a pocket 55 formed on the interior surface 42 of the coin for receiving the ball. That is, the viewing windows 40 may be placed immediately adjacent to the pockets 55, or closer to the pockets 55 than not. The cut-outs 35 forming viewing windows may be spaced equidistant apart or non-equidistant apart.

Each viewing window 40 may be assigned a value. The value may be, for example, a number, a letter, or another symbol that corresponds to an opportunity in a game, such as a game of chance. The opportunity may be moving a particular number of spaces, taking a particular number of game cards, or scoring a particular value, etc. The values can be assigned as desired and can be assigned sequentially or non-sequentially. As shown in FIG. 5, the values 49 can be printed or otherwise formed into an exterior face of the coin.

Figure 4:
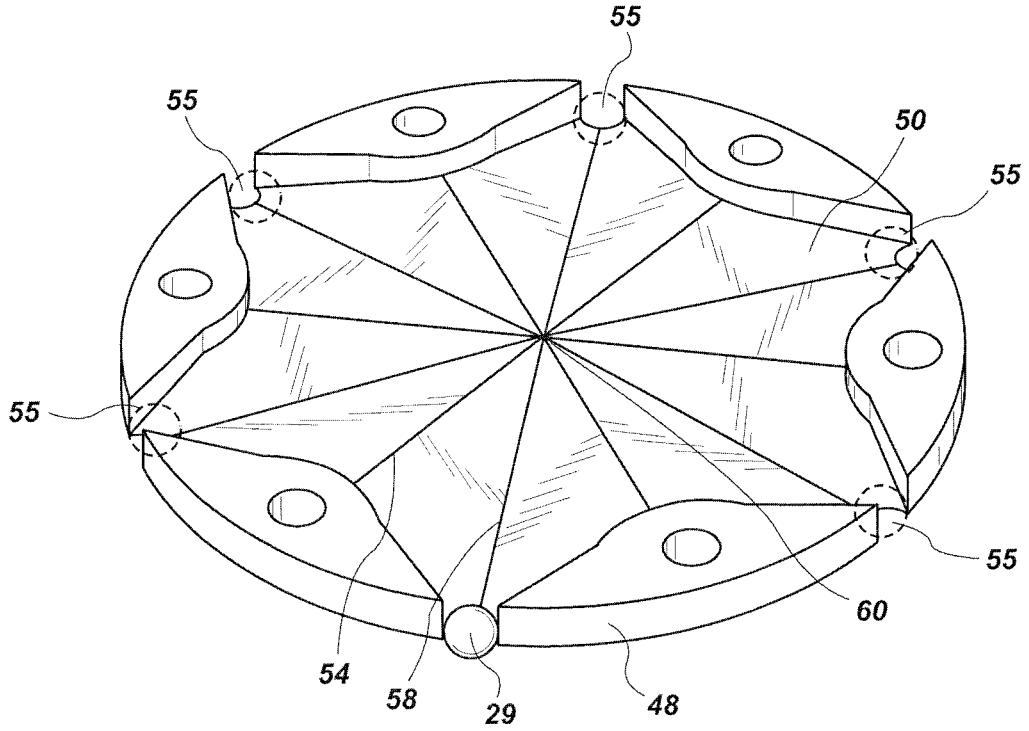
FIG. 4 is a perspective view of the interior of one side of the coin of FIG. 1, with a ball shown in the interior of the coin in a pocket of the interior.

With reference to FIGS. 3-4, on the interior surface 42 of each side of the coin, a plurality of sloped surfaces 50 are provided. Each of the sloped surfaces slopes downwardly from a center 60 of the interior of the coin towards a viewing window 40 at the edge 38, or perimeter, of the coin. In other words, the viewing window 40 is provided at the base of the sloped surface 50. The sloped surfaces 50 may be chosen to have a steeper slope or a shallower slope, but each of the sloped surfaces 50 may be sloped to the same degree so the ball(s) 29 have the same mechanical probability of falling towards each of the viewing windows 40. The configuration shown in FIGS. 3-4 have 6 sloped surfaces 50, corresponding to 6 viewing windows 40.

In the alternate, if a user wanted to configure the slope surfaces 50 to be different degrees of slope or distance to provide for a greater degree of success in obtaining a certain window 40, such is contemplated herein (although may be considered "cheating").

With the interior surfaces each sloped toward a viewing window, the viewing windows may be considered to form a type of pocket 55, or receptacle, for receiving the ball, with each of the sloped surfaces 50 sloped downwardly toward a respective pocket 55 at the base of each sloped surface. Pockets 55 may be spaced equidistant apart to equalize the relative probability of the ball 29 falling toward any particular pocket 55, or the pockets 55 may be spaced non-equidistant apart.

The sloped surfaces 50 may be sloped toward the viewing windows formed by recesses or cut-outs 35. The sloped surfaces 50 may be curved or they may be planar. FIGS. 1-5 show an interior surface 42 of each side of the coin 10 having planar sloped surfaces 50 comprised of ridges 54 and valleys 58. Each valley 58 slopes from its highest point at the center 60 of the coin downwardly towards a viewing window 40 or pocket 55 at the outer perimeter 38 of the coin. Referring to FIG. 4, pockets 55 are positioned and configured for receiving the ball(s) 29 at the base of each sloped surface 50, or at the bottom of each valley 58, in dashed lines. In this configuration, the interior of the coin 10 may be similar to a roulette wheel, with the ball 29 traveling along the ridges 54 and valleys 58 of the interior of the coin until the ball loses momentum and falls down one of the valleys 58 and lands in a pocket 55 proximal to a viewing window 40.

The plurality of slopes may include a first slope from the center of the coin to the periphery. A second slope may be from the apex of one of the ridges 54 to the base of one of the valleys 58. The slopes may be similar or the same from the base of each valley to the apex of each ridge, but different from the slope from the center of the coin to the periphery. However, the slopes may be the same or similar in each direction as well.

Referring to FIG. 5, the face 45, or second face 46, of the coin can be decorated with any features, such as a symbol that represents the game being played with the coin or a character within the game. The viewing windows 40 may extend to the face 45 of the coin 10, or the viewing windows 40 may be provided entirely on the edge 38, or perimeter, of the coin and not extend to the face 45 of the coin 10. Values 49 associated with each viewing window 40 may also be engraved, molded, printed, or otherwise formed onto the face 45. It will be appreciated that the face 45 and second face 46 may be the same or similar designs or different designs as well as the same values 49 on each. Alternatively, values 49 on the face 45 and second face 46 may be different so as to provide a different value depending on which side of the coin lands face-up thus providing more "chances" to each coin flip.

FIGS. 6-7 illustrates a coin or coins that include more pockets or receptacles, including more ridges 54 and valleys 58, corresponding to more pockets 55 and more sloped surfaces 55 and further corresponding to more windows 40 and/or cut-outs 35 within the coin for receiving ball(s) 29. Each of the pockets 55 corresponds to a sloped surface 50 that slopes from the center 60 of the coin 10 to the pocket 55 at the edge 38, or perimeter, the coin 10. In FIGS. 6-7, ten sloped surfaces are provided, each with a viewing window at the respective base at the edge of the coin. FIGS. 6-7 additionally illustrate that coins 110 may be used in pairs or groupings (as many coins as desired) if desired. For example, one coin with even numbers may be flipped or rolled, and another coin with odd numbers may be flipped or rolled. The coins may be flipped or rolled together as part of a single turn, or separately.

Several alternate configurations of the coin are possible. For example, FIGS. 1-2 show a coin 10 with a single ball 29 residing within the coin. In other configurations, two or more balls may be used as desired. For example, in configurations where two or more balls are used, the sum of the values assigned to each viewing window that each ball falls into can be added together. The ball 29 is shown in the figures as being round, but the ball can have a generally round shape and can include non-circular shapes as long as the ball can move or roll within the coin.

Similarly, the figures show a coin 10 which is circular or generally circular. This allows the coin to roll, but other shapes of the coin can also be used. Referring to FIG. **8*a*-11*b***, alternate embodiments may be shown that showcase a primarily polygonal shape from a top or bottom perspective.

Referring to FIGS. **8*a* and 8*b*, the polygonal shape of a coin 210 may be an octagon. The coin 210 may include the same or similar features as set forth in the previous embodiment. Additionally, the coin 210 may include cut-outs 212 along a planar side 214 of the coin 210. The cut-outs 212 correspond to similar pockets, valleys, ridges, and/or windows as previously disclosed herein. Furthermore, cut-outs 212 may reside on each planar side 214 of the coin 210 or may reside at only a single planar side 214** or anywhere from one planar side to all planar sides.

Alternatively, the cut-outs 212 may reside in the corners 216, or where to planar sides 214 intersect to form an angle. Again, cut-outs 212 may be in a single corner, or a plurality of corners of the coin 210. Securing two sides of the coin 210 may be done similar to the previous disclosed embodiments.

Figure 9A:
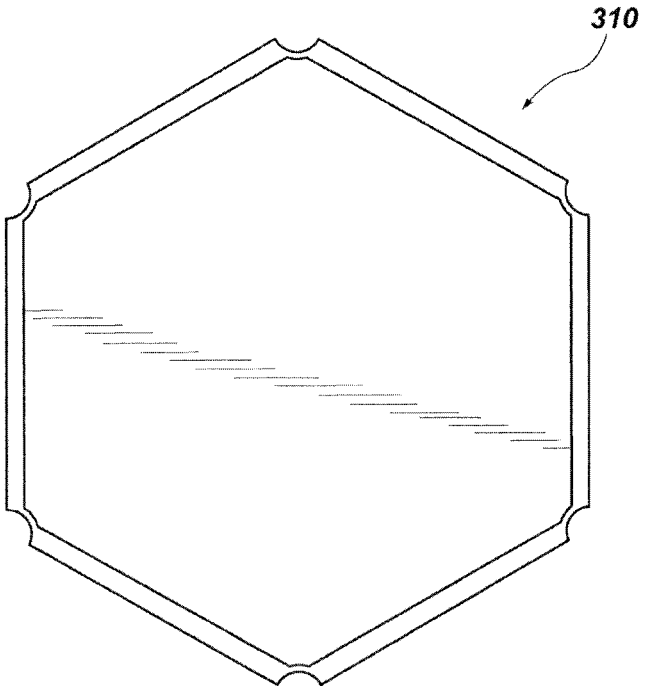
FIG. 9*a* is a top view of an alternate embodiment of a coin with a polygonal shape.
Figure 9B:
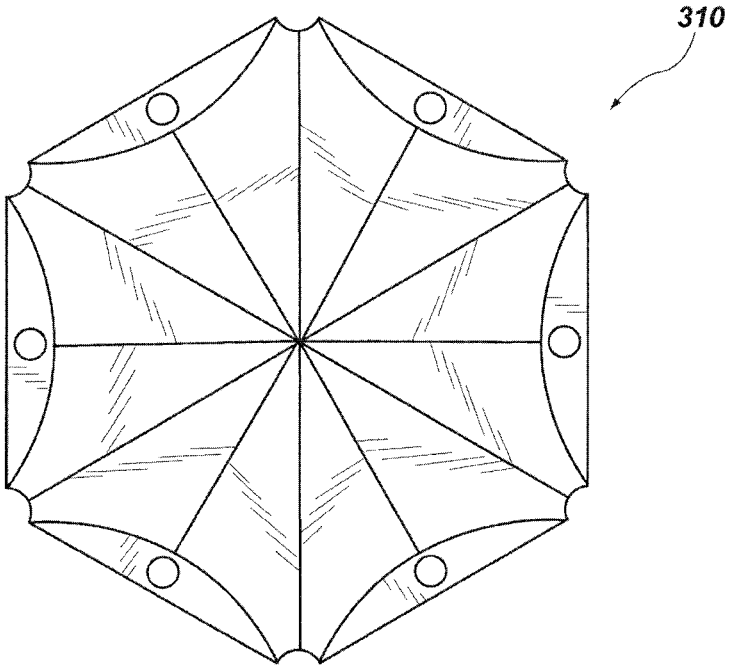
FIG. 9*b* is a top view of the interior of the coin of FIG. 9*a;*

Similar to the previous embodiment, referring to FIGS. 9*a* and 9*b*, a different polygonal shape coin 310 is contemplated which may be a hexagon. Features and elements of the hexagon coin 310 may be the same or similar to the previous embodiments disclosed herein.

Figure 10A:
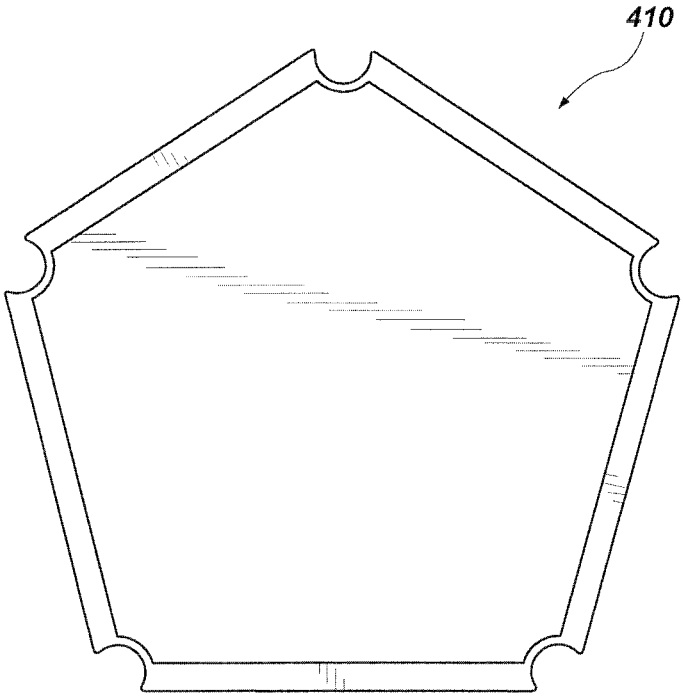
FIG. 10*a* is a top view of an alternate embodiment of a coin with a polygonal shape.
Figure 10B:
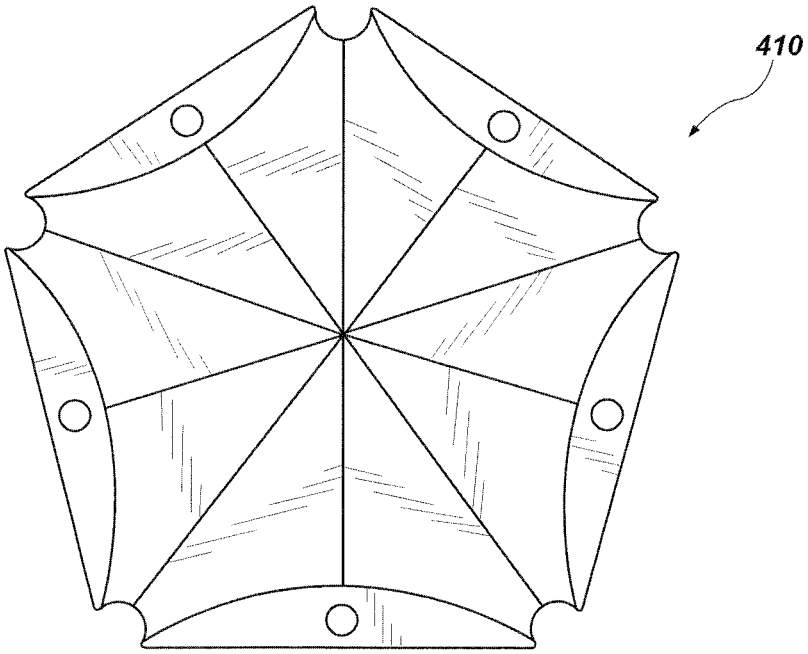
FIG. 10*b* is a top view of the interior of the coin of FIG. 10*a;*

Similar to the previous embodiment, referring to FIGS. 10*a* and 10*b*, a different polygonal shape coin 410 is contemplated which may be a pentagon. Features and elements of the pentagon coin 410 may be the same or similar to the previous embodiments disclosed herein.

Figure 11A:
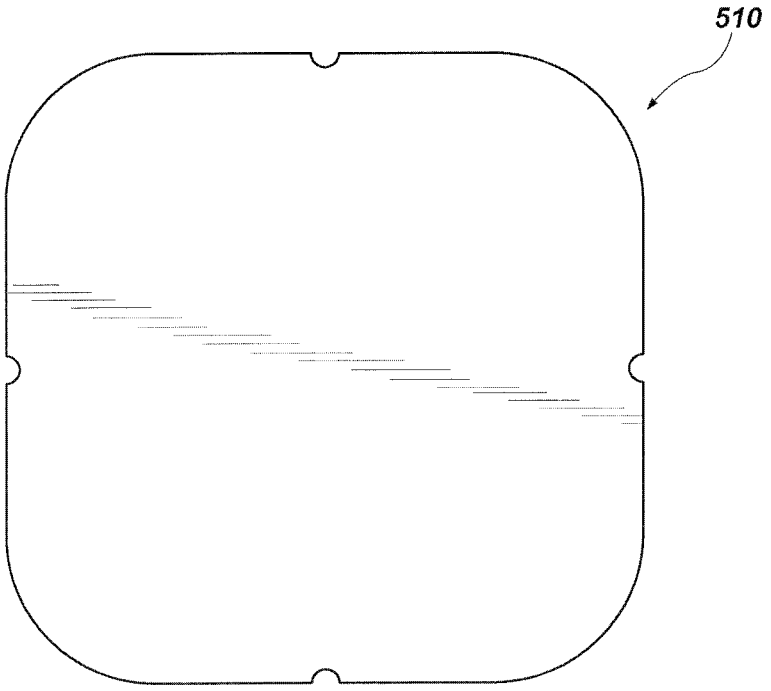
FIG. 11*a* is a top view of an alternate embodiment of a coin with a polygonal shape, which may be square shaped.
Figure 11B:
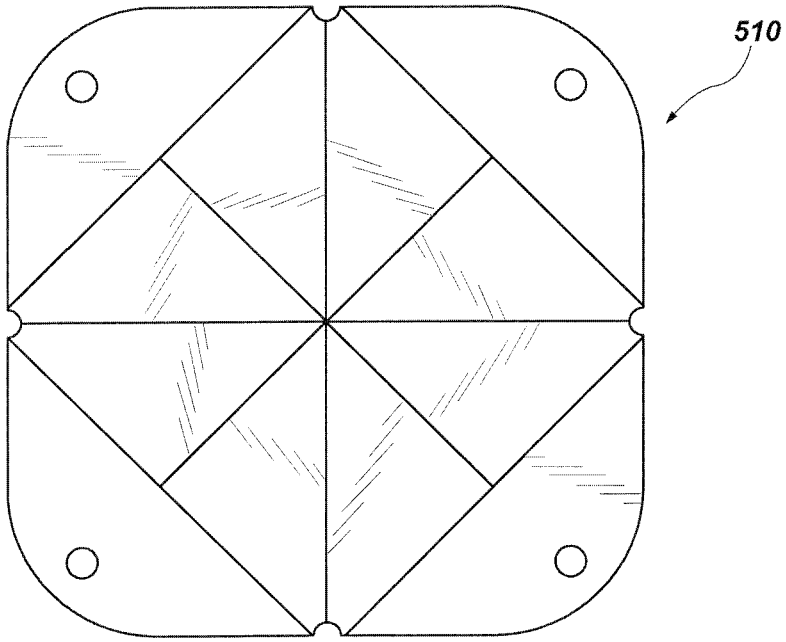
FIG. 11*b* is a top view of the interior of the coin of FIG. 11*a*.

Similar to the previous embodiment, referring to FIGS. 11*a* and 11*b*, a different polygonal shape coin 510 is contemplated which may be a square. Features and elements of the square coin 510 may be the same or similar to the previous embodiments disclosed herein.

Of each of the embodiments here, the figures may show a first side 15 of the coin and a second side 20 of the coin as being halves of the same coin. In other configurations, the first side 15 of the coin may include less than half of the coin, and the second side 20 may include more than half of the coin or vice versa. Or, the coin can include more than two portions connected together. In yet other configurations, the coin is formed of a unitary piece. It will further be appreciated that with any coin disclosed herein contemplates that any number of windows 40, cutouts 35, along with the corresponding pockets 55, sloped surfaces 50, ridges 54, and valleys 58 may be manufactured, molded, or machined into the current designs and the number of each of these elements is not considered a limiting.

The coins disclosed herein may be comprised entirely or partially of any type of any metal or metal alloy, wood, polymer, carbon fiber or the like or any combination thereof. The ball 29, likewise, may be comprised of a single or plurality of materials including any metal or metal alloy, wood, polymer, carbon fiber or the like.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A coin for use in a game, the coin comprising:

a first side connectable to a second side and forming a coin interior when the first side is connected to the second side, with at least one ball held in place in the coin interior, each of the first side and the second side comprising:

an exterior surface and an interior surface, the interior face comprising a first sloped surface and a second sloped surface, the first sloped surface sloped downwardly from a center of the coin to an edge of the coin and sloped towards a first viewing window, the first sloped surface forming a first receptacle for receiving the ball at a base of the first sloped surface and a first viewing window, the second sloped surface sloped downwardly from the center of the coin to the edge of the coin toward a second viewing window, the second sloped surface forming a second receptacle for receiving the ball at a base of the second sloped surface and a second viewing window, wherein the edge of the coin comprises the first viewing window and the second viewing window, each of the first viewing window and the second viewing window allowing the ball to be visible within one of the first receptacle and the second receptacle of the coin without allowing the ball to exit the coin interior of the coin.

2. The coin of claim 1, wherein the edge of the coin comprises a first cut-out forming the first viewing window and a second cut-out forming a second viewing window.

3. The coin of claim 1, wherein the first sloped surface and second sloped surface comprise a plurality of ridges and valleys.

4. The coin of claim 1, wherein the coin comprises more than two sloped surfaces and more than two receptacles for receiving the ball.

5. The coin of claim 4, wherein the more than two sloped surfaces are spaced equidistant apart.

6. The coin of claim 1, wherein two balls are held in place in the interior of the coin.

7. The coin of claim 1, wherein the exterior face comprises markings at each of the first viewing window and second viewing window, the markings symbolizing a value that relates to a game.

* * * * *